US010378714B2

(12) United States Patent
Kim et al.

(10) Patent No.: US 10,378,714 B2
(45) Date of Patent: Aug. 13, 2019

(54) LAMP FOR VEHICLE

(71) Applicant: SL Corporation, Daegu (KR)

(72) Inventors: Hyeong Do Kim, Gyeongsangbuk-Do (KR); Jong Woon Kim, Gyeongsangbuk-do (KR); Nak Jung Choi, Gyeongsangbuk-Do (KR); Ki Hae Shin, Gyeongsangbuk-do (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 16/028,808

(22) Filed: Jul. 6, 2018

(65) Prior Publication Data

US 2019/0032880 A1 Jan. 31, 2019

(30) Foreign Application Priority Data

Jul. 28, 2017 (KR) ..... 10-2017-0096350
Jun. 21, 2018 (KR) ..... 10-2018-0071230

(51) Int. Cl.

| | |
|---|---|
| ***F21S 8/00*** | (2006.01) |
| ***F21S 41/20*** | (2018.01) |
| ***F21S 41/141*** | (2018.01) |
| ***F21V 5/00*** | (2018.01) |
| ***F21S 41/663*** | (2018.01) |
| ***F21S 41/153*** | (2018.01) |
| *F21Y 105/16* | (2016.01) |
| *F21Y 115/10* | (2016.01) |

(52) U.S. Cl.

CPC ..... *F21S 41/20* (2018.01); *F21S 41/141* (2018.01); *F21S 41/153* (2018.01); *F21S 41/285* (2018.01); *F21S 41/663* (2018.01); *F21V 5/007* (2013.01); *F21Y 2105/16* (2016.08); *F21Y 2115/10* (2016.08)

(58) Field of Classification Search

CPC ..... F21S 41/25; F21S 41/141; F21S 41/20; F21S 41/663; F21S 41/153; B60Q 1/04; F21V 5/04; F21V 5/007

See application file for complete search history.

(56) References Cited

U.S. PATENT DOCUMENTS

| | | | | |
|---|---|---|---|---|
| 7,008,080 | B2 * | 3/2006 | Bachl | F21V 5/007 257/E25.02 |
| 2016/0265733 | A1 | 9/2016 | Bauer et al. | |
| 2016/0327235 | A1 | 11/2016 | Khrushchev | |

FOREIGN PATENT DOCUMENTS

| | | | | |
|---|---|---|---|---|
| DE | 102008031930 | A1 * | 1/2010 | F21V 5/04 |
| DE | 102012008833 | A1 * | 11/2012 | G02B 27/0927 |
| EP | 2436558 | A2 * | 4/2012 | B60Q 1/0058 |

(Continued)

*Primary Examiner* — Karabi Guharay

(74) *Attorney, Agent, or Firm* — Mintz Levin Cohn Ferris Glovsky and Popeo, P.C.; Kongsik Kim; Jhongwoo Jay Peck

(57) ABSTRACT

Provided is a lamp for a vehicle, and more particularly, which prevents a blind zone in a beam pattern and allows a boundary line of the beam pattern to have adequate sharpness. The lamp includes a light source portion which includes a plurality of micro light sources disposed to be spaced at predetermined gaps and a lens portion which includes a plurality of micro lenses disposed in front of at least one of the plurality of micro light sources. An incident surface of a micro lens has a dimension which includes a length of a micro light source corresponding to the micro lens and at least a part of a gap between the micro light source and an adjacent micro light source.

10 Claims, 11 Drawing Sheets

(56) References Cited

FOREIGN PATENT DOCUMENTS

| | | | |
|---|---|---|---|
| WO | 2017/066817 | A1 | 4/2017 |
| WO | 2017/066818 | A1 | 4/2017 |

* cited by examiner

FIG. 8

| REFRACTIVE INDEX | LUMINOUS INTENSITY(cd) OF FIRST AREA(A1) | LUMINOUS INTENSITY(cd) OF SECOND AREA(A2) | LUMINOUS INTENSITY RATIO |
|---|---|---|---|
| 1.1 | 115,000 | 82,100 | 1.40:1 |
| 1.2 | 102,000 | 85,000 | 1.20:1 |
| 1.3 | 93,000 | 80,870 | 1.15:1 |
| 1.4 | 86,300 | 82,000 | 1.05:1 |
| 1.5 | 80,400 | 80,000 | 1.01:1 |
| 1.6 | 77,200 | 77,000 | 1.00:1 |
| 1.7 | 71,900 | 68,500 | 1.05:1 |
| 1.8 | 66,700 | 61,500 | 1.08:1 |

FIRST AREA(A1) = AREA CORRESPONDING TO MICRO LIGHT SOURCE

SECOND AREA(A2) = AREA CORRESPONDING TO GAP BETWEEN ADJACENT MICRO LIGHT SOURCES

LAMP FOR VEHICLE

CROSS-REFERENCE TO RELATED APPLICATIONS

This application claims priority from Korean Patent Application No. 10-2017-0096350 filed on Jul. 28, 2017, and Korean Patent Application No. 10-2018-0071230 filed on Jun. 21, 2018. The applications are incorporated herein by reference.

BACKGROUND

1. Field of the Disclosure

The present disclosure relates to a lamp for a vehicle, and more particularly, to a lamp for a vehicle which prevents a shadow area in a beam pattern and allows a boundary line of the beam pattern to have adequate sharpness.

2. Description of the Related Art

Generally, a vehicle includes a variety of lamps which have an illumination function for recognizing an object near the vehicle during low light conditions (e.g., night) or a signaling function for informing other vehicles or road users of a driving state of the vehicle.

For example, a headlamp, a fog lamp, and the like generally have the illumination function, and a turn signaling lamp, a tail lamp, a brake lamp, a side marker lamp, and the like generally have the signaling function. Also, installation standards and specifications for the lamps are regulated by law so that each lamp can perform its function.

Among lamps for a vehicle, a headlamp, which forms a variety of beam patterns such as a low beam pattern and a high beam pattern to ensure a front field of vision for a driver during nighttime driving, performs an important function for driving safety.

In particular, when a shadow area is formed in a beam pattern formed by a head lamp, a field of vision of a user may be reduced. When a boundary line of a beam pattern has excessively high sharpness, a strong contrast between areas in which the beam pattern is formed and not formed may distract a driver and cause an increase in a possibility of occurrence of a car accident.

Accordingly, a method capable of preventing a shadow area in a beam pattern and of providing a boundary line of the beam pattern with adequate sharpness to prevent an increase in possibility of car accidents is needed.

The above information disclosed in this section is merely for enhancement of understanding of the background of the disclosure and therefore it may contain information that does not form the prior art that is already known in this country to a person of ordinary skill in the art.

SUMMARY

Aspects of the present disclosure provide a lamp for a vehicle which is capable of preventing a shadow area from forming in a beam pattern.

Aspects of the present disclosure also provide a lamp for a vehicle which allows a boundary line of a beam pattern to have adequate sharpness to reduce a contrast perceived by a user.

It should be noted that objects of the present disclosure are not limited to the above-described objects, and other objects of the present disclosure will be apparent to those skilled in the art from the following descriptions.

According to the aspects of the present disclosure, a lamp for a vehicle may include a light source portion with a plurality of micro light sources disposed to be spaced at predetermined gaps between them and a lens portion with a plurality of micro lenses disposed in front of at least one of the plurality of micro light sources. Here, an incident surface of a micro lens among the plurality of micro lenses may have a dimension which includes a length of a micro light source among the plurality of micro light sources corresponding to the micro lens and at least a part of a gap between the micro light source and an adjacent micro light source.

In some exemplary embodiments, a diameter of the micro lens may be equal to or greater than a diagonal distance of the micro light source and equal to or less than a distance obtained by adding half the gap between the micro light source and the adjacent micro light source to the diagonal distance of the micro light source.

The micro light source of the lamp may have a quadrangular shape, and a radius of curvature of the micro lens may be equal to or greater than half the diagonal distance of the micro light source. A refractive index of the micro lens may be selected from 1.4 to 1.8. Further, a light emission angle of light which is emitted by the micro lens may have a range from 35 to 90 degrees.

In addition, the plurality of micro lenses may increase a luminous intensity of a region corresponding to the gap to be within a predetermined luminous intensity range which includes a luminous intensity of light generated by the plurality of micro light sources.

The plurality of micro lenses may be disposed in front of some of the plurality of micro light sources which are disposed on one side with respect to a cut-off line, or in front of some of the plurality of micro light sources which form a cut-off line.

Details of other examples are included in a detailed description and drawings.

BRIEF DESCRIPTION OF THE DRAWINGS

The above and other aspects and features of the present disclosure will become more apparent by describing in detail exemplary embodiments thereof with reference to the attached drawings, in which:

FIG. 8 is a schematic diagram illustrating a luminous intensity ratio between an area corresponding to the micro light source and an area corresponding to a gap between adjacent micro light sources according to some exemplary embodiments of the present disclosure;

DETAILED DESCRIPTION

Figure 1:
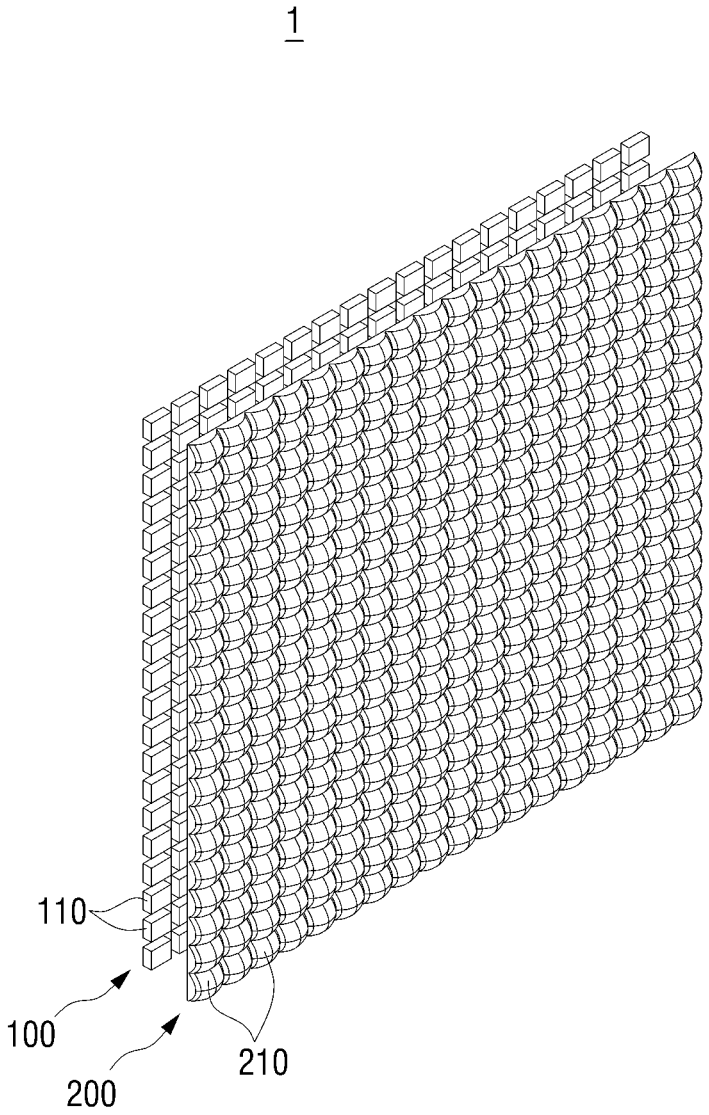
FIGS. 1 and 2 are perspective views of a lamp for a vehicle according to some exemplary embodiments of the present disclosure.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims. Throughout the specification, like reference numerals refer to like elements.

Accordingly, in some embodiments, well-known operations of a process, well-known structures, and well-known technologies will not be described in detail to avoid obscuring of understanding of the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to cross-sectional views and/or schematic diagrams which are exemplary views of the present disclosure. Accordingly, modifications may be made in the forms of exemplary views by a manufacturing technology, an allowable error, and/or the like. Accordingly, the embodiments of the present disclosure will not be limited to particular forms shown in the drawings and include changes in forms made according to a manufacturing process. Also, throughout the drawings of the present disclosure, components may be slightly exaggerated or reduced in consideration of convenience of description. Throughout the specification, like reference numerals refer to like elements.

Hereafter, a lamp for a vehicle according to some exemplary embodiments of the present disclosure will be described with reference to the drawings.

Figure 2:
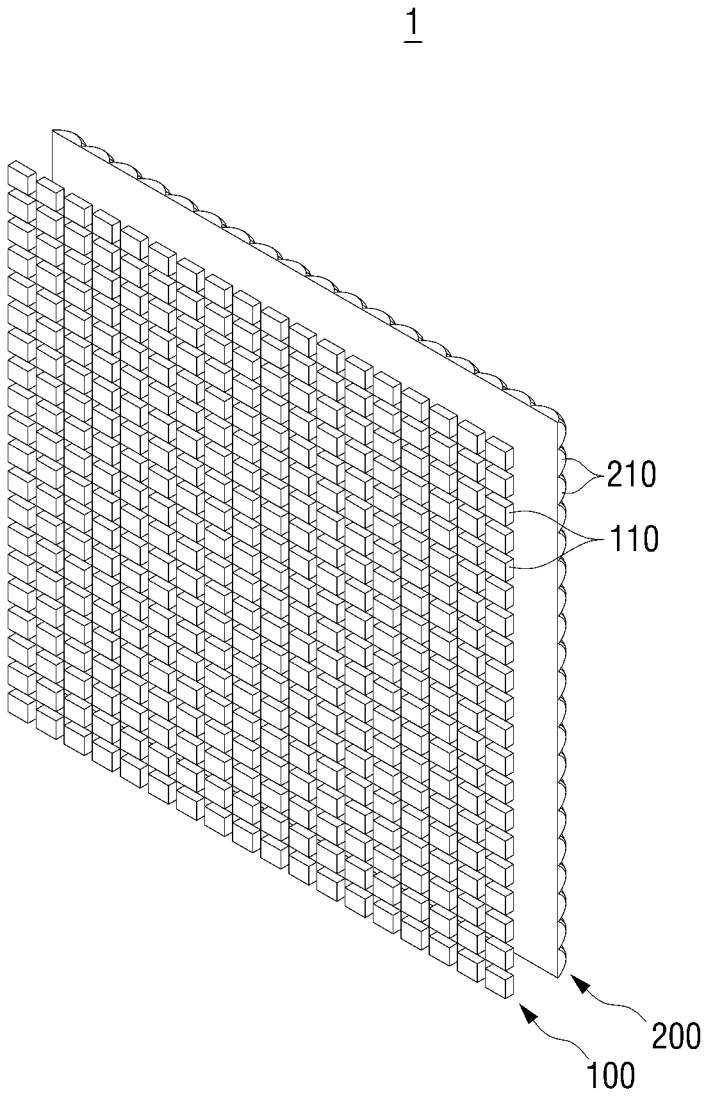
Figure 3:
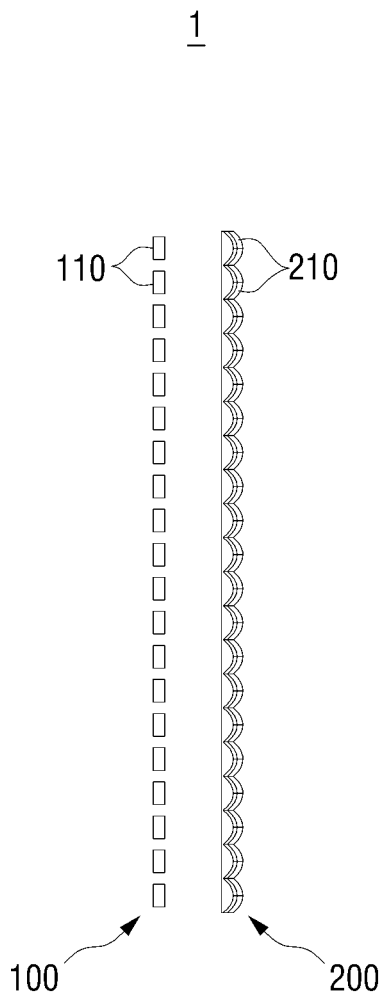
FIG. 3 is a side view of the lamp for the vehicle according to some exemplary embodiments of the present disclosure.

FIGS. 1 and 2 are perspective views of a lamp for a vehicle according to some exemplary embodiments of the present disclosure, and FIG. 3 is a side view of the lamp for the vehicle according to some exemplary embodiments of the present disclosure.

Referring to FIGS. 1 to 3, a lamp 1 for a vehicle according to some exemplary embodiments of the present disclosure may include a light source portion 100 and a lens portion 200. The light source portion 100 and the lens portion 200 may be disposed within an internal space formed by a lamp housing (not shown) and a cover lens (not shown) that is combined with the lamp housing.

In the exemplary embodiments of the present disclosure, the lamp 1 may be used as one of headlamps which are installed on both sides of a front of a vehicle to ensure a front field of vision by emitting light in a driving direction of the vehicle. However, the present disclosure is not limited thereto, and the lamp 1 may be used as not only a headlamp but also any one of a variety of lamps installed in a vehicle, such as a daytime running lamp, a fog lamp, a position lamp, a turn-signal lamp, a tail lamp, a brake lamp, a backup lamp, and the like.

When the lamp 1 is used as a headlamp, the lamp 1 may form a variety of beam patterns such as a low beam pattern and a high beam pattern based on a driving environment of a vehicle.

In the case of the low beam pattern, light is obstructed from being emitted above a cut-off line that includes a certain shape to prevent a driver of a vehicle in front or a vehicle approaching in an opposite lane from being blinded. The high beam pattern may be formed above the low beam pattern to perform a function of ensuring a broad field of vision.

The light source portion 100 may include a plurality of micro light sources 110. Here, at least one of the plurality of micro light sources 110 may be turned on based on a beam pattern formed by the lamp 1.

In some exemplary embodiments of the present disclosure, micro light emitting diodes (LEDs) that have a length 1/10th and an area 1/100th that of general LEDs and have a size from about 10 to 100 micro meters may be used as the plurality of micro light sources 110.

The light generated by each of the plurality of micro light sources 110 may have a certain light emission angle with respect to an optical axis which perpendicularly passes a center of a light emission surface of each of the plurality of micro light sources 110. As the plurality of micro light sources 110 become closer to the optical axis, since the light emission angle is smaller, luminous intensity may become increased. As the plurality of micro light sources 110 become farther from the optical axis, since the light emission angle is greater, luminous intensity may become decreased.

For example, the light generated by each of the plurality of micro light sources 110 may have a light emission angle within a range of about 90 degrees in a certain direction with respect to an optical axis. As the light emission angle approaches 0 degrees, the light may proceed substantially forward such that luminous intensity may increase. As the light emission angle approaches 90 degrees, the light may spread to sideways such that luminous intensity decreases.

Forward projection of the light generated by the plurality of micro light sources 110 may be defined as being projected in a direction in which the light is emitted by the lamp 1, and therefore the forward direction may vary based on a position, a direction, or the like in which the lamp 1 is installed.

The plurality of micro light sources 110 may be disposed to be spaced apart at predetermined gaps to prevent structural interference among them. In this case, the luminous intensity may be rapidly reduced in areas corresponding to the gaps among the plurality of micro light sources 110 such that shadow areas may be formed.

When shadow areas are formed among the plurality of micro light sources 110 as described above, an unnecessary shadow area may be formed in a beam pattern produced by the light source portion 100 such that not only a field of vision of a driver may be reduced but also the sharpness at a boundary line of the beam pattern, for example a cut-off line of a low beam pattern, may be increased by the light source portion 100. Accordingly, the driver may perceive a strong contrast between an area with the beam pattern formed therein and an area with no beam pattern formed therein and may be distracted.

In this case, the sharpness at the boundary line of the beam pattern may increase, as described above, as the luminous intensity may be rapidly reduced among the plurality of micro light sources 110 such that the rate of luminous intensity change increases relatively.

Accordingly, in some exemplary embodiments of the present disclosure, the light generated by at least some of the plurality of micro light sources 110 may be collected to have an adequate light emission angle such that forming of a shadow area between the adjacent micro light sources 110 may be prevented while a boundary line of a beam pattern has adequate sharpness so as to reduce a contrast perceived by the driver.

The lens portion 200 may include a plurality of micro lenses 210 disposed in front of at least some of the plurality of micro light sources 110. FIGS. 1 to 3 illustrate an exemplary case in which the lens portion 200 includes the plurality of micro lenses 210 disposed in front of the plurality of micro light sources 110, respectively.

Hereinafter, in some exemplary embodiments of the present disclosure, one of the plurality of micro light sources 110 and one of the plurality of micro lenses 210, which correspond to each other, will be described as an example and others of the plurality of micro light sources 110 and the plurality of micro lenses 210 may be equally applied.

Figure 4:
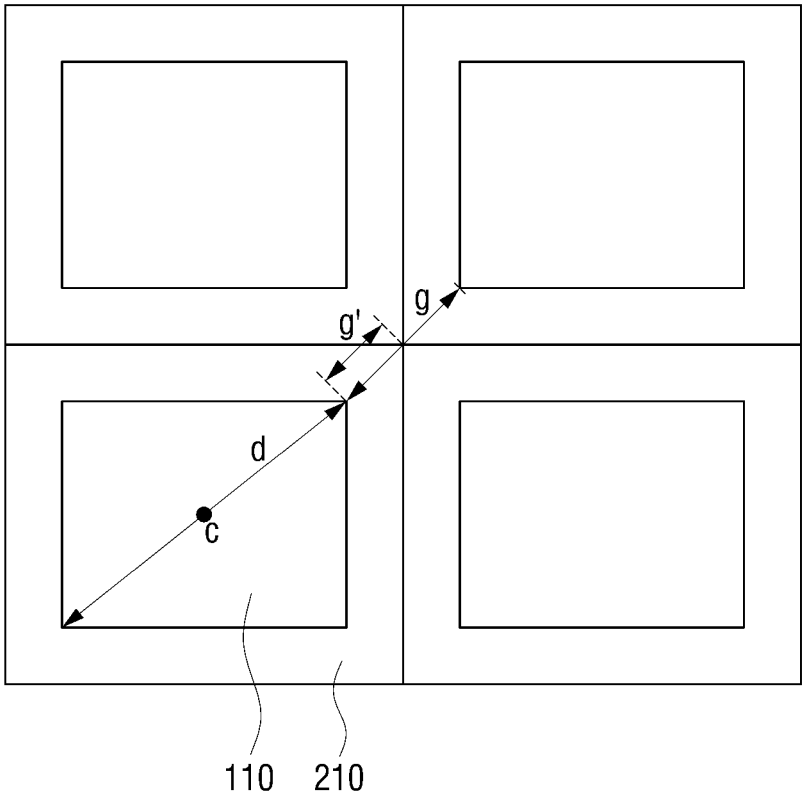
FIG. 4 is a schematic diagram illustrating micro light sources and micro lenses according to some exemplary embodiments of the present disclosure.

FIG. 4 is a schematic diagram illustrating the micro light sources and the micro lenses according to some exemplary embodiments of the present disclosure. Referring to FIG. 4, the micro lens 210 according to some exemplary embodiments of the present invention may have a diameter greater than or equal to a longest distance d among distances between two opposing points on a perimeter of the micro light source 110, the two opposing points being disposed on a line that passes a center c of the micro light source 110.

For example, when the micro light source 110 has a quadrangular shape as shown in FIG. 4, the longest distance among distances between two opposing points on the perimeter of the micro light source 110 which are located on a line that passes the center c of the micro light source 110 may be a diagonal distance d. In this case, the diameter of the micro lens 210 may be greater than or equal to the diagonal distance d.

In addition, the diameter of the micro lens 210 may be less than or equal to a distance d+g' obtained by adding at least a part (e.g., fraction or portion) g' of a gap distance g from another adjacent micro light source to the diagonal distance d of the micro light source 110. When the diameter of the micro lens 210 is greater than the distance d+g' obtained by adding at least the part g' of the gap g from the other adjacent micro light source to the diagonal distance d of the micro light source 110, a diameter of the micro lens corresponding to the other adjacent micro light source may be decreased such that a beam pattern formed by the lamp 1 may not have overall uniform luminous intensity.

For example, the diameter of the micro lens 210 may be the distance d+g' obtained by adding the distance g' which is half of the gap distance g from the other adjacent micro light source to the diagonal distance d of the micro light source 110. This way, the diameters of the plurality of micro lenses 210 corresponding to the plurality of micro light sources 110, respectively, may be uniformly formed so as to allow the beam pattern formed by the lamp to have overall uniform luminous intensity.

In some exemplary embodiments of the present disclosure, the diameter of the micro lens 210 being equal to or greater than the diagonal distance d of the micro light source 110 and being equal to or less than the distance d+g' obtained by adding the distance g' which is half of the gap distance g from the other adjacent micro light source to the diagonal distance d of the micro light source 110 may prevent formation of a shadow area due to decreased luminous intensity at an area corresponding to the gap between the adjacent micro light sources.

By way of example, the diameter of the micro lens 210 may be formed to be equal to or great than the diagonal distance d of the micro light source 110 and equal to or less than the distance d+g' obtained by adding the distance g' which is half the gap g from the other adjacent micro light source to the diagonal distance d of the micro light source 110. This is because, since a gap in a diagonal direction is greatest among gaps between the adjacent micro light sources, it is necessary to prevent formation of a shadow area between the micro light sources adjacent to each other in the diagonal direction.

In FIG. 4, it may be noted that an incident surface of the micro lens 210 has a quadrangular shape not a circular shape. This may be understood that the micro lens 210 is first formed to have the diameter equal to or greater than the diagonal distance d of the micro light source 110 and equal to or less than the distance obtained by adding the distance g' which is half the gap g to both sides of the diagonal distance d as described above (e.g., d+2g' or d+g), and then the micro lens 210 is subsequently processed to have a corresponding shape of the micro light source 110.

In other words, in some exemplary embodiments of the present disclosure, the micro lens 210 may be formed to have an incident surface with a diagonal distance which is equal to or great than the diagonal distance d of the micro light source and equal to or less than the distance d+g which includes at least the part g' of the gap g between the other adjacent micro light sources added to both sides of the diagonal distance d of the micro light source 110 to prevent formation of a shadow area between the adjacent micro light sources.

In addition, in some exemplary embodiments of the present disclosure, a radius of curvature of the micro lens 210 may be equal to or greater than half the diagonal distance d. However, the radius of curvature of the micro lens 210 is not limited thereto and may vary based on the gaps between the plurality of micro light sources 110.

An aspheric lens may be used as the micro lens 210 for aberration correction, shape control, or the like. When an aspheric lens is used as the micro lens 210, the aspheric lens may be designed in consideration of a conic constant, aspheric coefficients, and the like.

Figure 5A:
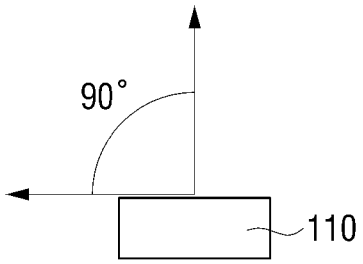
FIGS. 5A and 5B are schematic diagrams illustrating a light emission angle of the micro lens according to some exemplary embodiments of the present disclosure.
Figure 5B:
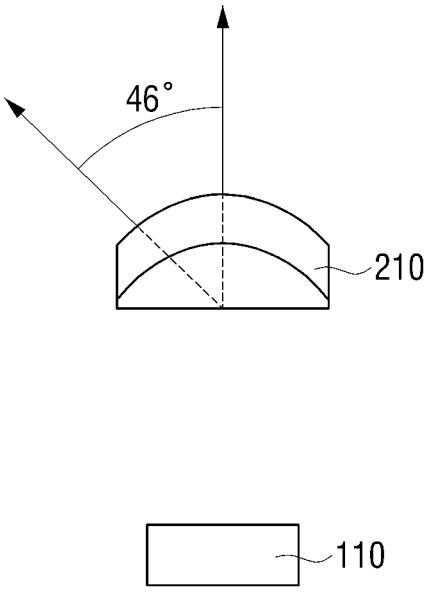

When the micro lens 210 is disposed in front of the micro light source 110 as described above, the light generated at a light emission angle within a range of about 90 degrees with respect to an optical axis of the micro light source 110 as shown in FIG. 5A may be emitted at a light emission angle within a range of about 46 degrees with respect to an optical axis of the micro lens 210 as shown in FIG. 5B such that a shadow area between the adjacent micro light sources may be prevented from forming.

Figure 6A:
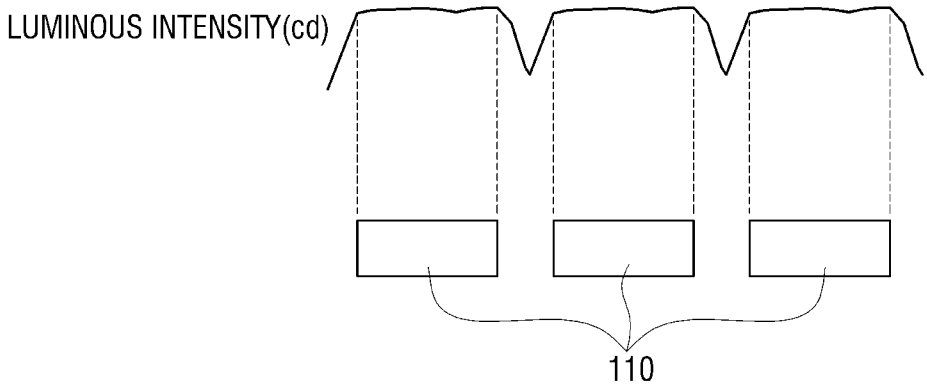
FIGS. 6A and 6B are schematic diagrams illustrating luminous intensity of the lamp for a vehicle according to some exemplary embodiments of the present disclosure.
Figure 6B:
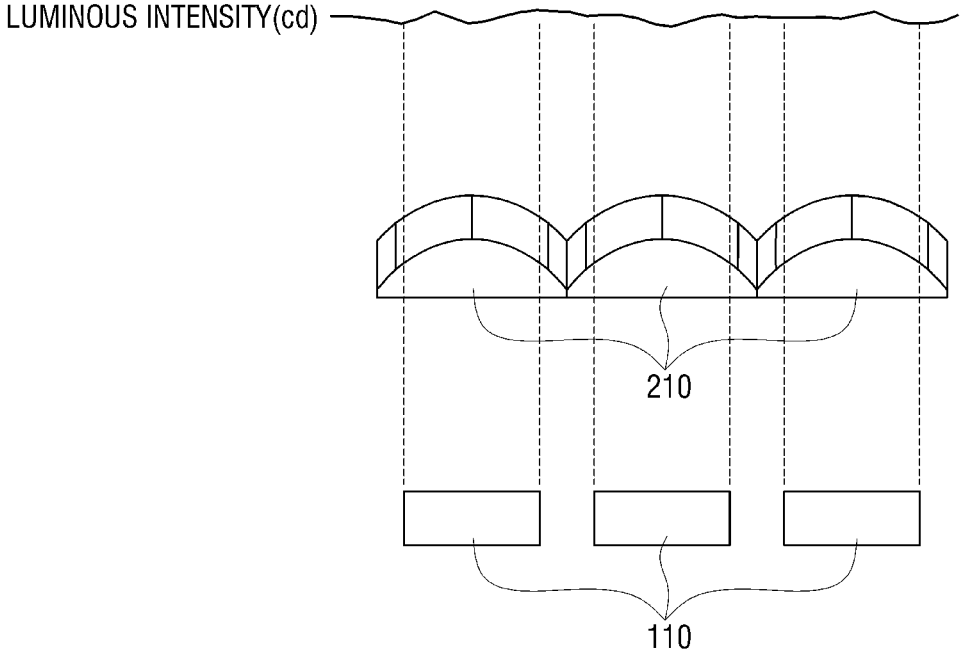

When the micro lens 210 is not used, a region in which the luminous intensity relatively decreases is formed between the adjacent micro light sources 110 as shown in FIG. 6A such that a shadow area is formed and a beam pattern includes a boundary line with high sharpness. On the other hand, in some exemplary embodiments, since the micro lens 210 is disposed in front of the micro light source 110 to have overall uniform luminous intensity as shown in FIG. 6B, a shadow area may be prevented from forming between the adjacent micro light sources, and the boundary line of the beam pattern may have adequate sharpness.

For example, when the micro lens 210 is not used, as shown in FIG. 6A, the luminous intensity in an area corresponding to a gap between the adjacent micro light sources 110 is reduced to be about 50% or less from that of the optical axis of the micro light source 110 such that a shadow area may be formed. On the other hand, when the micro lens 210 is disposed in front of the micro light source 110 as shown in FIG. 6B, the luminous intensity in an area corresponding to a gap between the adjacent micro light sources 110 increases to be within a certain luminous intensity range which includes the luminous intensity at the optical axis of the micro light source 110.

Although it is described as an example that the micro lens 210 increases the luminous intensity in the area, which corresponds to the gap between the adjacent micro light sources 110, to be within the certain luminous intensity range which includes the luminous intensity at the optical axis of the micro light source 110 in some exemplary embodiments of the present disclosure, it is merely an example for aiding in understanding of the present disclosure and the micro lens 210 is not limited thereto and may increase the luminous intensity in an area where a shadow area is not formed in a beam pattern formed by the lamp 1.

In some exemplary embodiments of the present disclosure, the light emission angle of the light emitted by the micro lens 210 which has a range of 46 degrees is merely an example for aiding in understanding of the present disclosure. The light emission angle range of the light emitted by the micro lens 210 is not limited thereto and may vary based on a curvature, a refractive index, or the like of the micro lens 210.

In some exemplary embodiments of the present disclosure, a material having a refractive index of 1.4 to 1.8 may be used as the micro lens 210. The refractive index of the micro lens 210 may vary base on a light emission angle range and the like of the light emitted by the micro lens 210. The refractive index of the micro lens 210 being within a range from 1.4 to 1.8 is an example to prevent forming of a shadow area caused by a difference in the luminous intensities between an area corresponding to the micro light source 110 and an area corresponding to the gap between the adjacent micro light sources.

Figure 7:
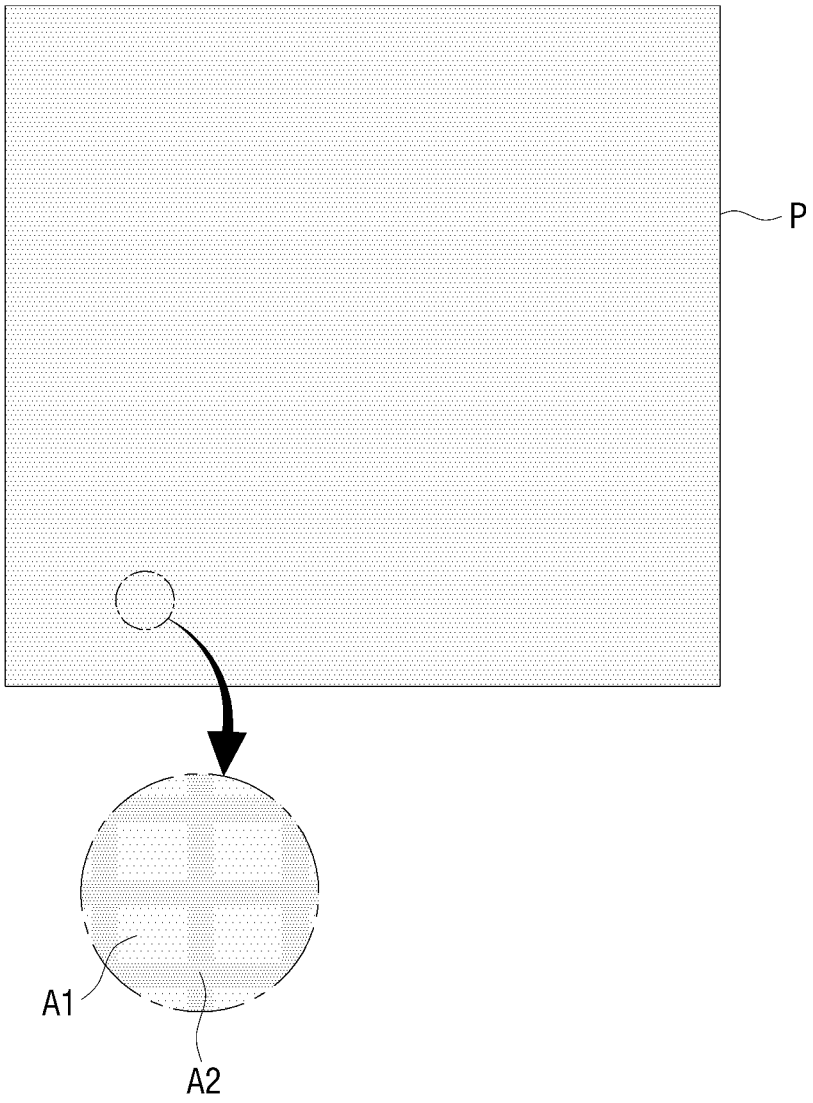
FIG. 7 is a schematic diagram illustrating a beam pattern formed by the lamp for a vehicle according to some exemplary embodiments of the present disclosure.

In other words, a beam pattern P formed by the lamp 1 may include a first area A1 that corresponds to the micro light source 110 and a second area A2 that corresponds to the gap between the adjacent micro light sources as shown in FIG. 7. When a luminous intensity ratio between the first area A1 and the second area A2 is 1.1:1 or less, i.e., the luminous intensity of the first area A1 is equal to or less than 1.1 times the luminous intensity of the second area A2, a shadow area may be prevented from occurring in the beam pattern P formed by the lamp 1 and the beam pattern P may have overall uniform luminous intensity.

FIG. 8 is a table that lists luminous intensity ratios between an area corresponding to the micro light source and an area corresponding to a gap between the adjacent micro light sources according to some exemplary embodiments of the present disclosure. Referring to FIG. 8, which compares the luminous intensity ratios between the first area A1 and the second area A2 for various refractive indices of the micro lens 210, when the refractive index is 1.1, 1.2, and 1.3, it may be noted that the luminous intensity ratio becomes 1.4:1, 1.2:1, and 1.15:1, respectively, and the luminous intensity of the first area A1 is higher than the luminous intensity of the second area A2 compared to when the refractive index is 1.4 to 1.9. In this case, a shadow area may be formed in the beam pattern P formed by the lamp 1.

Accordingly, in some exemplary embodiments of the present disclosure, the refractive index of the micro lens 210 may have a value from 1.4 to 1.8 to allow the luminous intensity ratio between the first area A1 and the second area A2 to be 1.1:1 or less so as not to form a shadow area in the beam pattern P formed by the lamp 1.

The above-described luminous intensity in FIG. 8 is merely an example for showing the luminous intensity according to a refractive index of the micro lens 210 and the luminous intensity of the first area A1 and the second area A2 may vary based on the luminous intensity of the micro light source 110.

Further, the light emission angle range of the light emitted by the micro lens 210 being about 46 degrees is merely an example for aiding in understanding of the present disclosure, and the micro lens 210 may have a light emission angle within a range from 35 to 90 to prevent formation of a shadow area in the gap between the adjacent micro lenses.

In particular, the light emission angle of the micro lens 210 having a range from 35 to 90 degrees may allow the luminous intensity of light emitted by the micro lens 210 to be 30% or more of the luminous intensity of the light generated by the micro light source 110 to satisfy light distribution regulations and to ensure sufficient visibility at the same time.

In other words, when the light emission angle of the micro lens 210 is outside of the range of 35 to 90 degrees, light efficiency may become less than 30%, and it may be difficult to meet the light distribution regulations and ensure sufficient visibility. Accordingly, the light emission angle may have the range of 35 to 90 degrees.

In the above-described exemplary embodiments, it has been described as an example that the lens portion 200 includes the plurality of micro lenses 210 disposed in front of the plurality of micro light sources 110, respectively. However, the present disclosure is not limited thereto and the micro lenses 210 may be disposed in front of at least some of the micro light sources 110 depending on a beam pattern.

Figure 9:
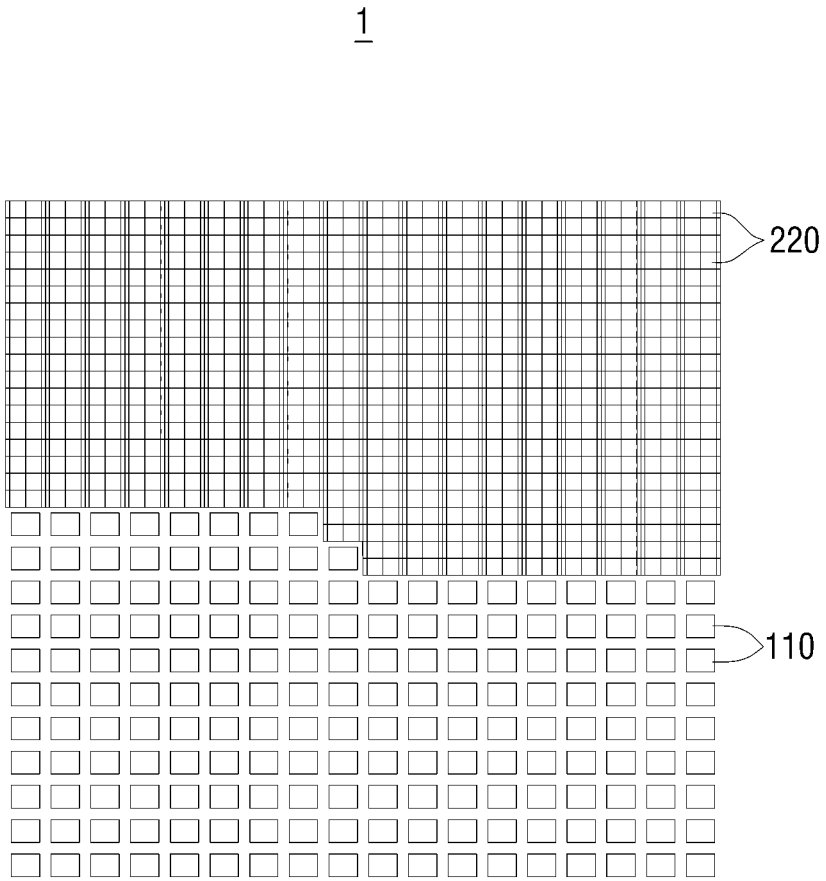
FIG. 9 is a front view of a lamp for a vehicle according to other exemplary embodiments of the present disclosure.

For example, the lens portion 200, as shown in FIG. 9, may include a plurality of micro lenses 220 disposed in front of some of the plurality of micro light sources 110 which form a low beam pattern.

Here, the micro light sources which form the low beam pattern may be disposed above a cut-off line as the light source portion 100 and the lens portion 200 are disposed within an internal space defined by the lamp housing and the cover lens, and when a projection lens is used as the cover lens, the light which passes through the projection lens is shown in a reverse (e.g., inverted) image.

Figure 10:
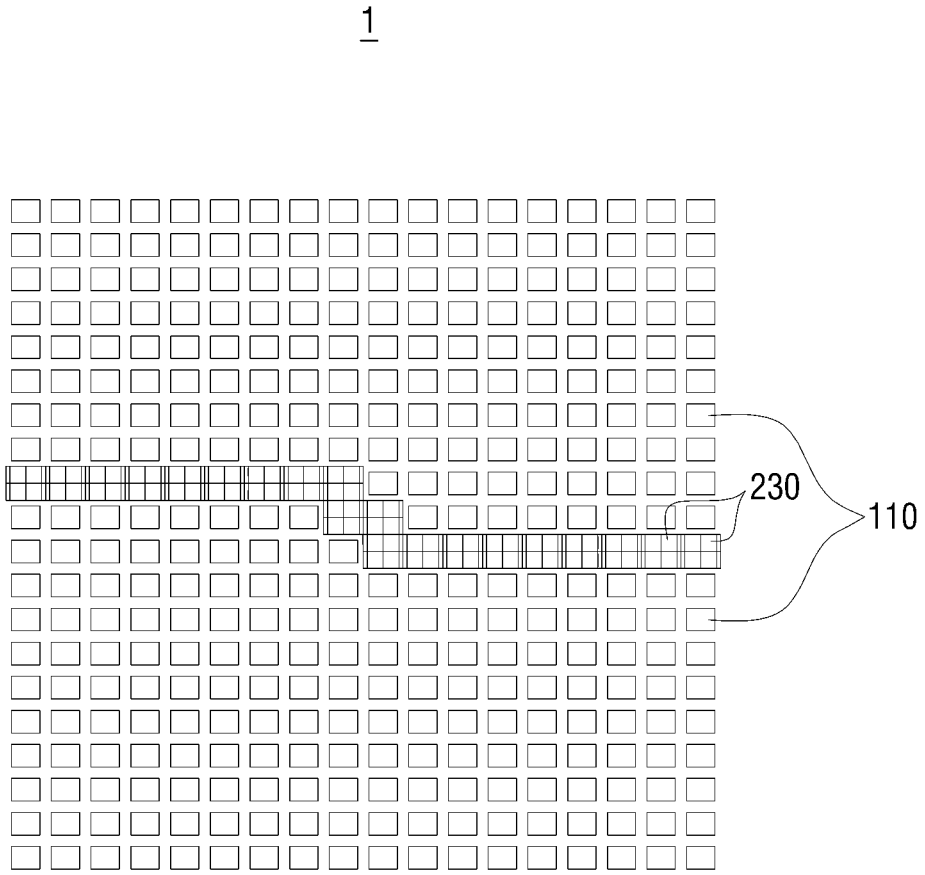
FIG. 10 is a front view of a lamp for a vehicle according to still other exemplary embodiments of the present disclosure.

Additionally, the lens portion 200, as shown in FIG. 10, may include a plurality of micro lenses 230 disposed in front of some of the micro light sources forming the low beam pattern, which form the cut-off line.

Figure 11:
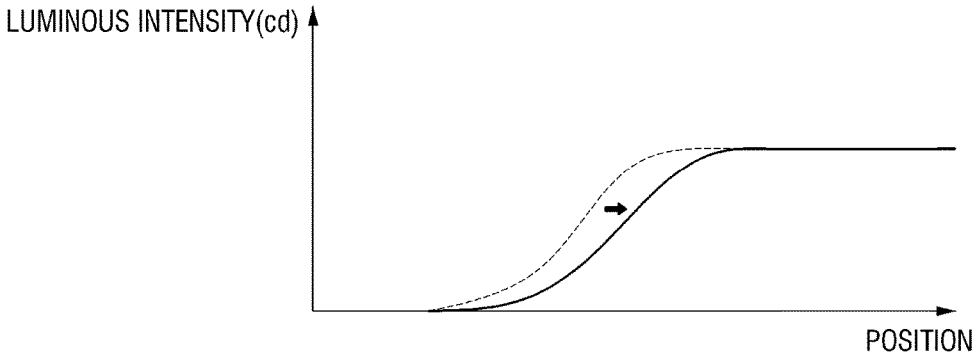
FIG. 11 is a schematic diagram illustrating a luminous intensity change rate of a cut-off line of the beam pattern formed by the lamp for a vehicle according to some exemplary embodiments of the present disclosure.

In FIG. 10, when the micro lenses are disposed in front of the micro light sources which form the cut-off line, as shown in FIG. 11, the rate of luminous intensity change based on a position on the cut-off line in a vertical direction may be gradual such that the cut-off line may have adequate sharpness. The rate of luminous intensity change may be gradual similar to the description with reference to FIGS. 9 and 10. The dotted line in FIG. 11 indicates the rate of luminous intensity change when there is no micro lens.

As described above, the lamp 1 may prevent a shadow area from forming between adjacent micro light sources and allow a boundary line of a beam pattern to have adequate sharpness by disposing the plurality of micro lenses 210, 220, and 230 in front of at least some of the plurality of micro light sources 110 such that a driver may be prevented from being distracted by reducing a difference perceived by the driver to reduce a possibility of car accidents.

According to the exemplary embodiments of the present disclosure, a lamp for a vehicle may provide one or more effects as follows.

A micro lens may be disposed in front of a micro light source to prevent a shadow area caused by an area that corresponds to a gap between adjacent micro light sources such that a field of vision of a user may not be deteriorated.

Since a boundary line of a beam pattern may have adequate sharpness by disposing a micro lens in front of a micro light source which forms the boundary line of the beam pattern, a contrast perceived by a driver may be reduced such that the driver may not be distracted.

Effects of the present disclosure will not be limited to the above-mentioned effects and other unmentioned effects will be clearly understood by those skilled in the art from the following claims.

It should be understood by one of ordinary skill in the art that the present disclosure can be embodied in other specific forms without changing the technical concept and essential features of the present disclosure. Therefore, the above-described embodiments should be understood to be exemplary and not limiting in any aspect. The scope of the present disclosure will be defined by the following claims, and all variations and modifications derived from the meaning and the scope of the claims and equivalents thereof should be understood as being included in the scope of the present disclosure.

What is claimed is:

1. A lamp for a vehicle, comprising:

a light source portion which includes a plurality of micro light sources disposed to be spaced at predetermined gaps therebetween; and a lens portion which includes a plurality of micro lenses disposed in front of at least one of the plurality of micro light sources, wherein an incident surface of a micro lens among the plurality of micro lenses has a quadrangular shape and a dimension which includes a length of a micro light source among the plurality of micro light sources corresponding to the micro lens and at least a part of a gap between the micro light source and an adjacent micro light source, and an exit surface of the micro lens has a convex curvature, and wherein the lamp is configured to turn on a first set of the plurality of micro light sources and turn off a second set of the plurality of micro light sources to form a beam pattern.

2. The lamp of claim 1, wherein a diagonal distance of the incident surface of the micro lens is equal to or greater than a diagonal distance of the micro light source.

3. The lamp of claim 2, wherein the micro light source has a quadrangular shape.

4. The lamp of claim 2, wherein a radius of curvature of the micro lens is equal to or greater than half the diagonal distance of the micro light source.

5. The lamp of claim 1, wherein a refractive index of the micro lens is 1.4 to 1.8.

6. The lamp of claim 1, wherein a light emission angle of light which is emitted by the micro lens has a range from 35 to 90 degrees.

7. The lamp of claim 1, wherein the plurality of micro lenses are configured to increase a luminous intensity of a region corresponding to the gap to be within a predetermined luminous intensity range which includes a luminous intensity of light generated by the plurality of micro light sources.

8. The lamp of claim 1, wherein the plurality of micro lenses are disposed in front of some of the plurality of micro light sources which are disposed on one side with respect to a cut-off line.

9. The lamp of claim 1, wherein the plurality of micro lenses are disposed in front of some of the plurality of micro light sources which form a cut-off line.

10. The lamp of claim 1, wherein the beam pattern include a first area that corresponds to the micro light source and a second area that corresponds to the gap between the micro light source and the adjacent micro light source, and a luminous intensity ratio between the first area and the second area is equal to or less than 1.1:1.

* * * * *